United States Patent [19]

Adams

[11] Patent Number: 4,730,284

[45] Date of Patent: Mar. 8, 1988

[54] ALARM CLOCK

[76] Inventor: Michael E. Adams, 5 Revere Dr., Suite 200, Northbrook, Ill. 60062

[21] Appl. No.: 66,631

[22] Filed: Jun. 25, 1987

Related U.S. Application Data

[63] Continuation-in-part of Ser. No. 939,630, Dec. 8, 1986, abandoned.

[51] Int. Cl.[4] ..... G04B 21/02; G04C 21/00

[52] U.S. Cl. ..... 368/72; 368/250; 368/272

[58] Field of Search ..... 368/10, 45, 63, 72–75, 368/286, 250, 251, 262, 272–273

[56] References Cited

U.S. PATENT DOCUMENTS

| | | | |
|---|---|---|---|
| 2,406,251 | 8/1946 | Porcelli | 368/45 |
| 2,926,487 | 3/1960 | Stone | 368/45 |
| 3,835,640 | 9/1974 | Hughes, Jr. | 368/63 |
| 4,098,068 | 7/1978 | Masuyama | 368/272 |
| 4,481,852 | 11/1984 | Makuta et al. | 368/272 |
| 4,488,272 | 12/1984 | Scott, Jr. | 368/273 |
| 4,488,820 | 12/1984 | Takebe | 368/273 |
| 4,531,841 | 7/1985 | Puff | 368/63 |

FOREIGN PATENT DOCUMENTS

| | | | |
|---|---|---|---|
| 2944268 | 5/1981 | Fed. Rep. of Germany | 368/272 |

*Primary Examiner*—Vit W. Miska

*Attorney, Agent, or Firm*—Hill, Van Santen, Steadman & Simpson

[57] ABSTRACT

An alarm clock in the shape of an animal standing atop a base includes a clock mechanism and a sound generating circuit connected to the clock mechanism to produce an alarm sound characteristic of the animal represented by the shape of the alarm clock. That body part of the represented animal from which the novel alarm sound is popularly believed to emanate is manually manipulated to cancel and reset the alarm sound.

13 Claims, 6 Drawing Figures

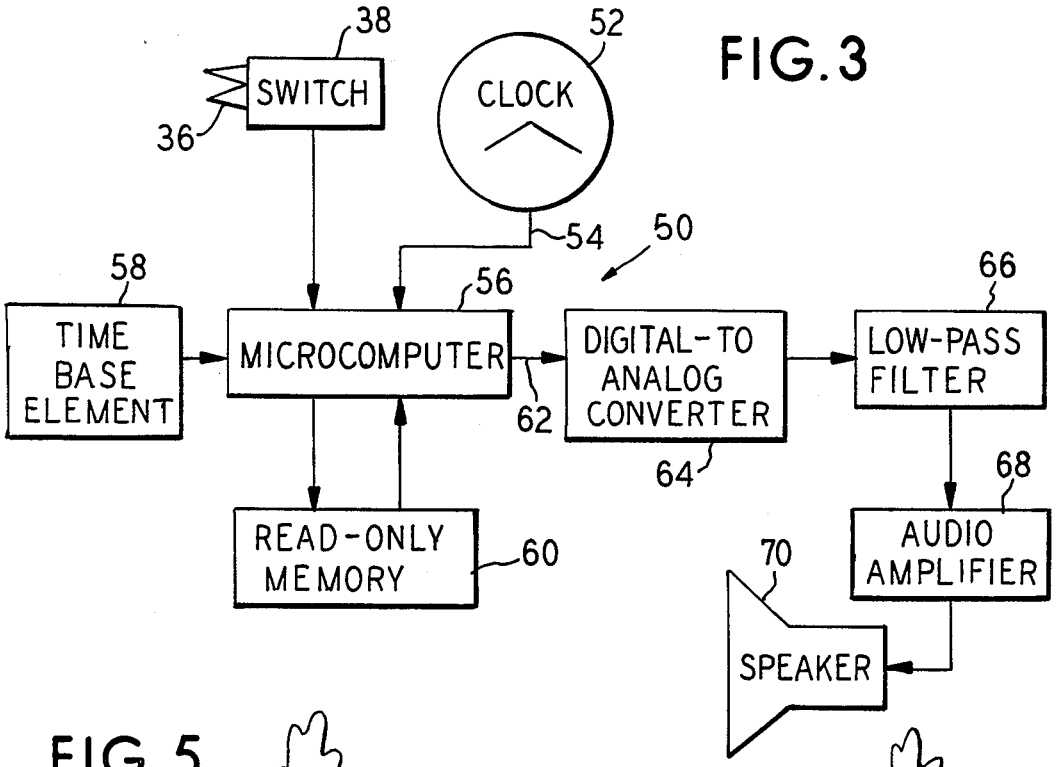
FIG. 3
FIG. 5
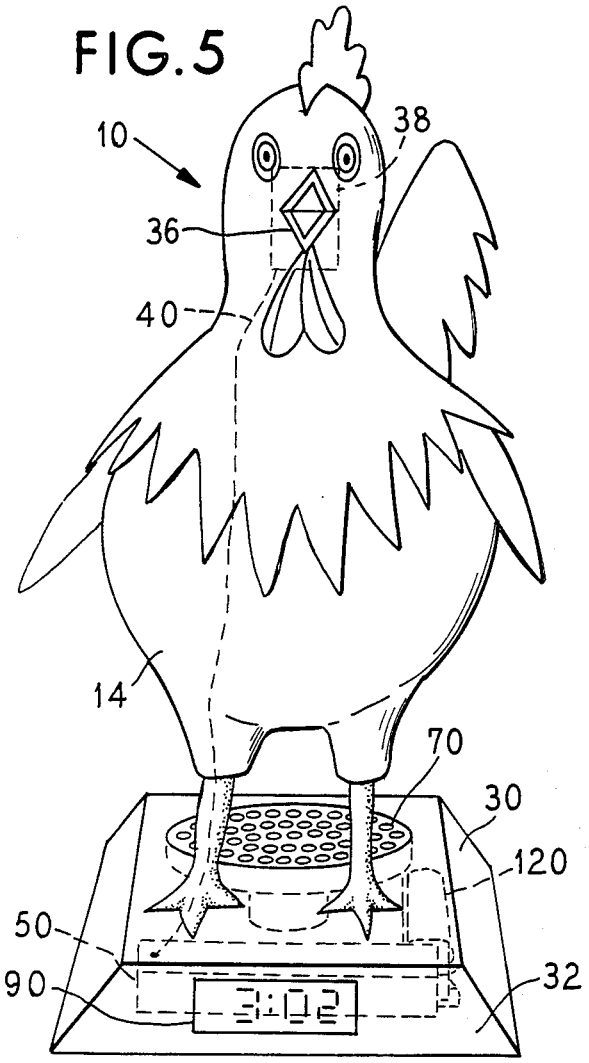
FIG. 6
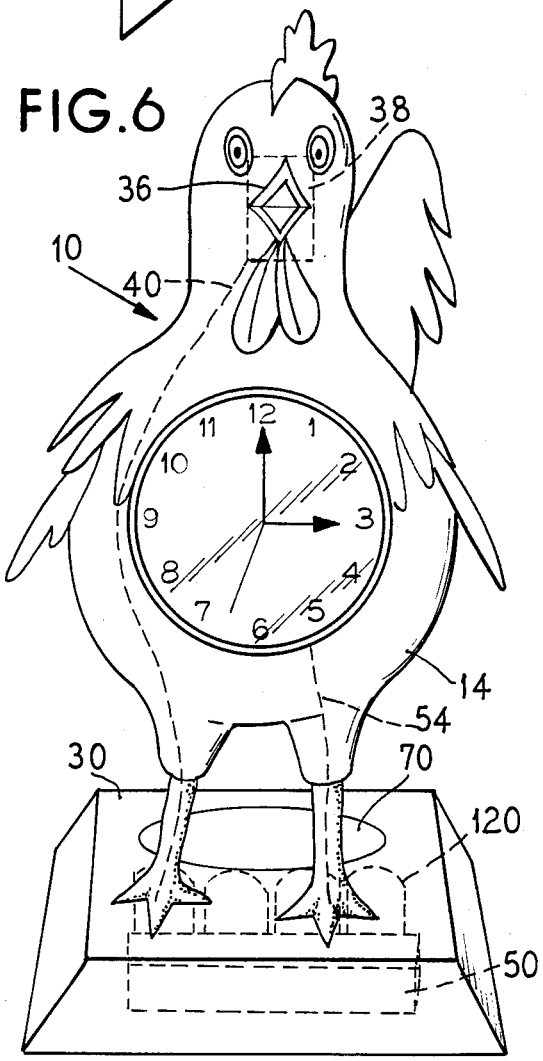

ALARM CLOCK

This application is a continuation-in-part of application Ser. No. 939,630, filed Dec. 8, 1986 entitled: "ALARM CLOCK", now abandoned.

BACKGROUND OF THE INVENTION

1. Field of the Invention

The present invention relates to an alarm clock and, more particularly, to an alarm clock having an alarm sound corresponding in a known way to the overall shape of the alarm clock.

2. Description of the Prior Art

Alarm clocks are known, generally having an overall geometric shape. The common alarm signal of known clocks is either a ringing or buzzing sound, or radio programming of one variety or another. Many of the known alarm clocks have a "snooze" feature. On these clocks, the alarm signal can be made to repeat one or more times beyond the initial sounding so that one can postpone rising and yet still benefit from the broadcast of an alarm announcement.

A relatively new category called novelty alarm clocks are rapidly gaining in popularity. Based primarily on cartoon or other childrens characters, these clocks typically combine a stylized housing with a "wake up message" delivered in the represented characters voice.

An alarm clock is disclosed in German Pat. No. 29 44 268 to M. Hausser, published Nov. 2, 1979 in which a cockerel is mounted on or has therewithin an alarm clock with a tone generator for producing a simulated cock crow. The head of the cockerel may be tipped up, the beak opened and the wings moved during the cock crow. There is no provision in the Hausser disclosure, however, for an alarm shut-off and reset switch which represents a body part of the cockerel.

SUMMARY OF THE INVENTION

An object of the present invention is to provide an alarm clock in the shape of an animal. A further object of the present invention is to provide an alarm clock in the shape of an animal, wherein the alarm announcement has a sound characteristic of the represented animal. A further object of the present invention is to provide an alarm clock in the shape of an animal wherein the alarm signal is both cancelled and reset by manipulation of that body part of the represented animal from which the characteristic sound is popularly believed to emanate. Examples of body parts from which characteristic animal sounds are popularly believed to emanate include the trunk of an elephant for the trumpeting sound, the hind legs of a cricket for a chirping sound, or the beak of a rooster for a crowing sound.

These and other objects of the invention are accomplished in an alarm clock having a shape representing an animal, such as a rooster, and may include the figure atop a base. The alarm clock includes a clock mechanism and display, alarm circuitry designed to produce an alarm signal characteristic of the depicted animal and a switch representing the body part from which the characteristic sound is popularly believed to emanate. In one example, the alarm clock is provided in a plush toy rooster and the control circuit generates an alarm signal having the sound of "cock-a-doodle-doo". In the example, a spring-loaded beak connected to a switch both cancels and then resets the alarm signal to sound again the following day at the predetermined time.

The alarm clock circuitry, speaker and power source are generally located in the base on which the rooster stands. The clock mechanism and display, on the other hand, can be located in either the body of the rooster or the base, depending on the embodiment chosen.

Should the user fail to respond to the initial alarm sounding, repeated alarm announcements are made as needed over a predetermined period of time and at predetermined intervals to provide a "snooze" wake-up feature. Also, there is a predetermined period of time before the preset alarm event during which the user can cancel the alarm event by operation of the cancel and reset switch. Finally, should the user fail to manually disarm the alarm circuitry during the predetermined "snooze" period, the alarm mechanism would automatically reset itself to sound at the preset time the following day.

Regarding the actual construction of the exemplary embodiment, it is suggested that the eyes, beak, feet, and base of the rooster be made of either a plastic or plastic-based material. The rooster body itself would ideally be either an injection-molded figure—painted, or with color-molded, snap together parts—or an injection or blow molded form over which a "plush" fur skin—incuding comb, waddles, and feathers, etc.—would be either glued or removably fitted.

Referring now to the construction of the base of the exemplary embodiment, it will preferably be formed having a sealed cavity within which all electronic and electrical components and connections—aside from the clock assemblies themselves—are safely housed. The base also generally includes a snap-in or hinged panel on either side through which the battery clip or container can be easily accessed. Finally, in the case of some embodiments of the present invention, the base further includes openings on its underside through which time and alarm setting posts can easily be reached.

BRIEF DESCRIPTION OF THE DRAWINGS

FIG. 3 is a functional block diagram of an alarm announcement circuit for use in the alarm clock of the present invention;

FIG. 5 is a front perspective view of a second embodiment of an alarm clock according to the principles of the present invention having an electronic or digital-rather than analog-clock display and mechanism within the supporting base; and FIG. 6 is a front perspective view of a third embodiment of an alarm clock according to the principles of the present invention illustrating an analog clock display and mechanism within the rooster body.

DESCRIPTION OF THE PREFERRED EMBODIMENTS

Figure 1:
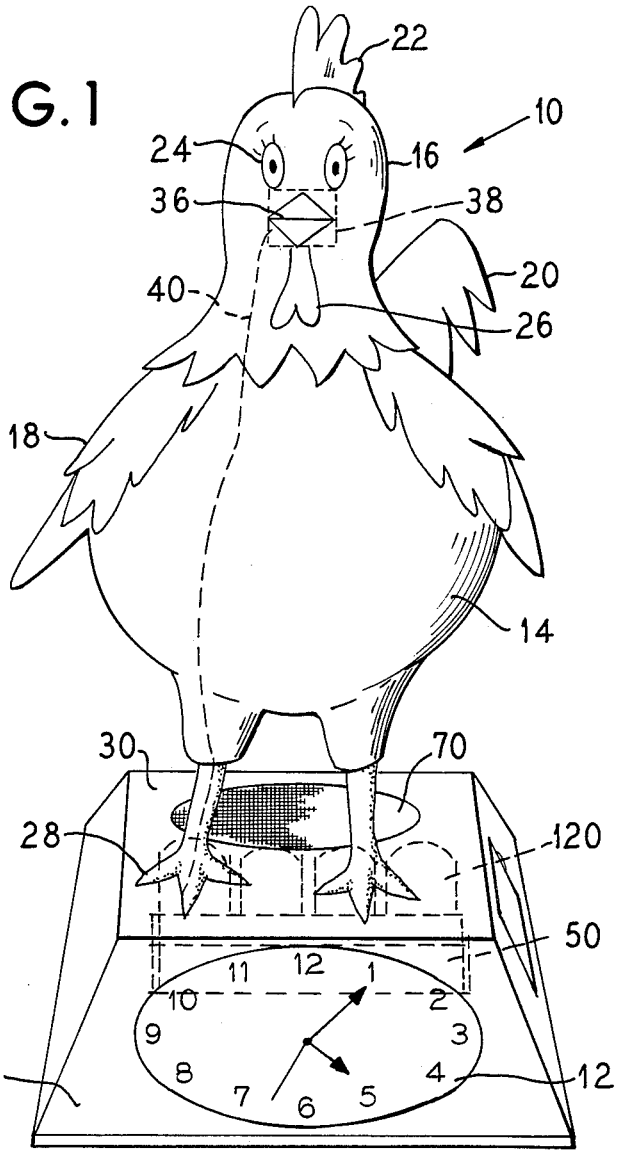
FIG. 1 is a front perspective view of a first embodiment of an alarm clock according to the principles of the present invention.
Figure 2:
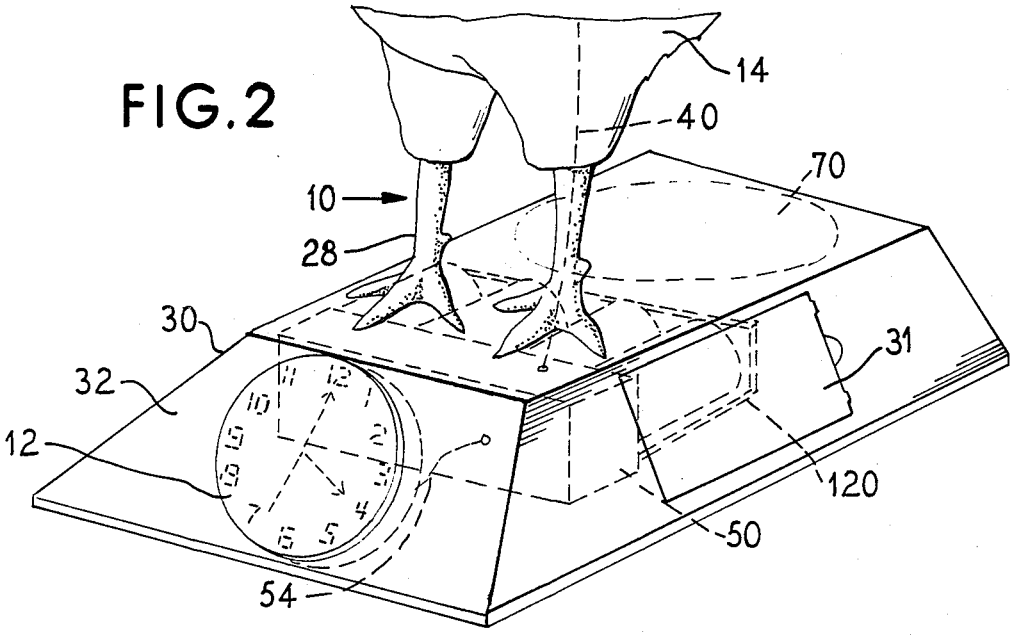
FIG. 2 is a perspective view of the lower portion of the alarm clock of FIG. 1.

FIGS. 1 and 2 illustrate a first embodiment of the alarm clock of the present invention, generally by the numeral 10. The alarm clock 10 includes an "analog" clock display and mechanism 12 within a front side 32 of a base member 30, the front side 32 being enlarged on this embodiment only to accomodate a large, easy-to-read analog clock face. The clock face includes not only second and minute hands, but also an alarm indicator hand.

Standing atop the base 30 is a stylized rooster figure 14 having a head 16, wings 18, tail 20, comb 22, eyes 24, waddles 26, and feet 28.

Extending outwardly from the rooster head 16 is a spring-biased, hinged beak 36 to which a switch 38 is connected. Connected to the alarm circuitry 50 by means of an electrical connection 40, this switch 38 both cancels and automatically resets the alarm sound "cock-a-doodle-doo" whenever the beak 36 is pinched shut and then released. The beak of the rooster is that body part from which the "cock-a-doodle-do" sound is popularly believed to emanate, even though the vocal cords in the throat of a live rooster are actually responsible for producing the sound.

The electrical connection 40 passes from the switch 38 through the rooster body 14 and through a hollowed-out one of a pair of feet 28 to the alarm circuitry 50 located in the base 30.

Adjustments to time and alarms settings on the clock mechanism in this embodiment are made on setting posts (not shown) which are easily accessible from beneath the base 30. In FIG. 2 can be seen a door 31 in the base 30 through which access is provided for replacing batteries and the like.

Referring now to FIG. 3, a schematic of the sound generating and alarm timing circuit 50 for use in the present alarm clock 10 is shown. The circuit 50 includes a clock element 52 which is preferably a known clock unit having an alarm control output 54 that is activated when a preset alarm time has been reached. The clock element 52 can be either digital or analog, or of any other type. A microcomputer 56 is provided for a sound generating and alarm sequence protocol control. An alarm sequence is initiated by the microcomputer 56 when a signal is received thereby over the alarm control output 54. A time-base element 58, such as a quartz crystal, supplies a regular time signal to the microcomputer 56 so that the alarm protocol, sound generation, and other functions are coordinated. The microcomputer 56 is also linked to a read-only memory 60 which contains an encoded digital representation of the desired electronic audio signal for the alarm such as the characteristic sound of the represented animal, along with other program data necessary to the operation of the circuit 50. Although the encoded representation can take any of several well known forms, it is preferably a sequence of binary values, equally spaced in time, which correspond to the wave shape to be reproduced. The wave shape of the illustrated embodiment is a "cock-a-doodle-doo" which corresponds to the rooster shape.

When an alarm event is to occur as indicated by the clock element 52, the micro-computer 56 transmits the encoded signal over an output 62 to a digital-to-analog converter 64 which accepts the digital bit sequence for conversion into a corresponding voltage value in the form of the desired audio signal. At the output of the digital-to-analog converter 64, is a low-pass filter 66 which removes unwanted frequencies from the reconstructed audio signal to prevent aliasing, which would otherwise distort the sound. The low pass filter 66 feeds an audio amplifier 68, which in turn transmits an amplified signal to a speaker 70 from which the desired audio sound is broadcast.

The switch 38 is also linked to the microcomputer 56 and is activated by a user through manipulation of the beak 36 to cancel alarm events. Operation of the switch 38 also causes a re-alarm sequence protocol to be executed by the microcomputer 56, which uses a regular timing signal from the time-base element 58.

Through the use of known microcomputer programming techniques, any number of different alarm sequence protocols could be provided. In one example, the alarm sound "cock-a-doodle-doo"—the digital encoding for which is in the read-only memory 60—is grouped in sets of three calls each. The alarm event or alarm sequence is broadcast at the preset time as determined by the clock 52. Preferably, the alarm sequence would be periodically rebroadcast for a predetermined period of time after the preset time so that, if he chooses to disregard the original alarms sounding, the user could "snooze" and still be awakened later by a further alarm announcement. In one embodiment for example, the alarm sequence could be broadcast at the preset time, and again, as needed, 15 minutes later, 30 minutes later, 40 minutes later, 50 minutes later, 55 minutes later, and finally one full hour after the preset time. The microcomputer 56 times the sequence periods by using the signal from the time-base element 58. Thus, timed reoccurrances of the alarm event follow for up to one hour after the preset time.

Both the initial alarm signal, and the one hour follow-up sequence of alarm soundings would be cancelled and reset at any time during this one hour period by manipulation of the beak 36. Furthermore, activation of the switch 38 at any time for up to one hour before the preset time will also cancel and reset the alarm sequence in this embodiment.

Figure 4:
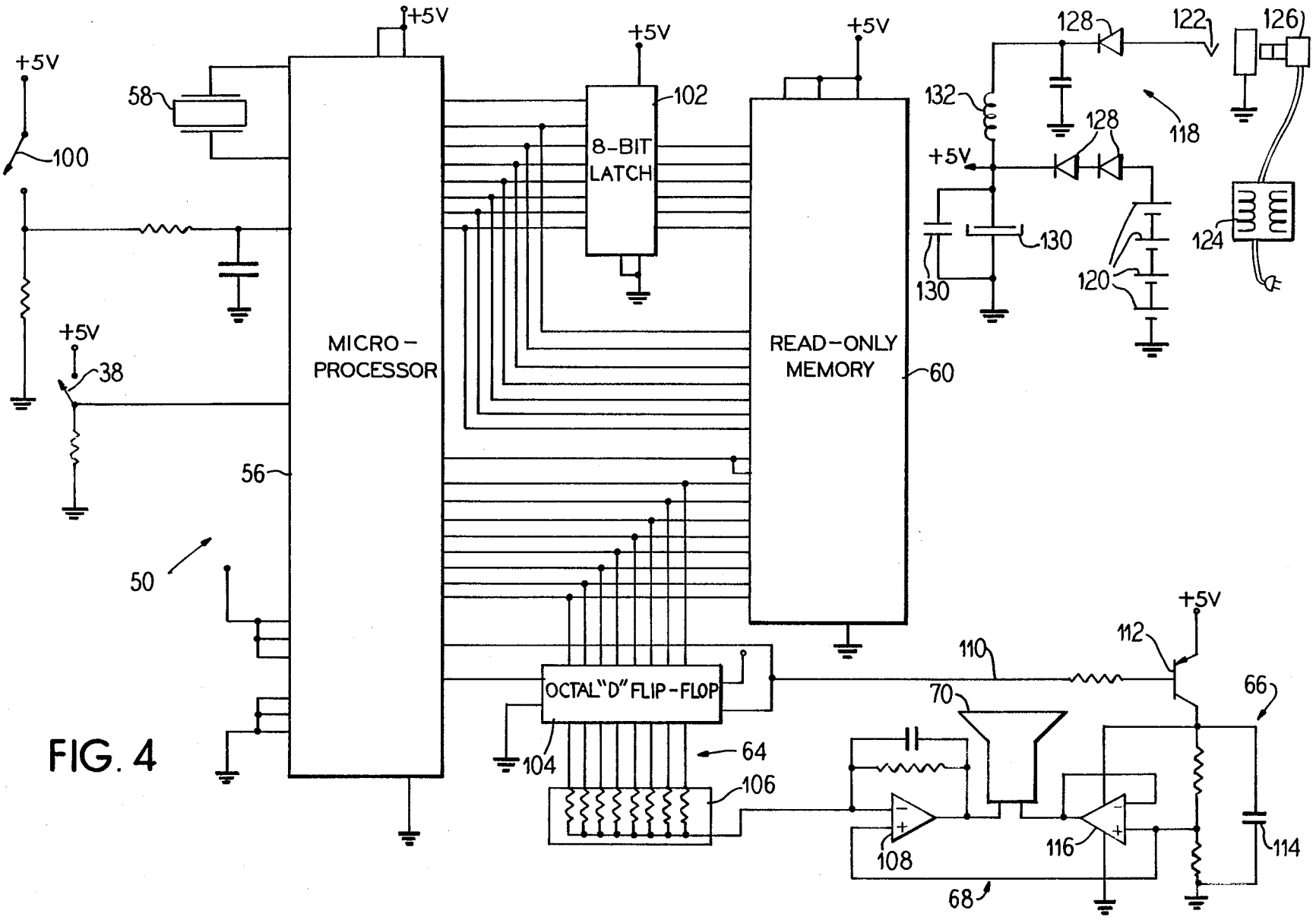
FIG. 4 is a circuit diagram of the alarm sound generator of FIG. 3.

In FIG. 4, a specific embodiment of the circuit 50 shown schematically in FIG. 3 is shown. In particular, the microcomputer 56, which is a microprocessor chip, has a first input connected to a clock switch 100 which is activated by the clock 52 to start the alarm sequence. In one embodiment, the switch 100 remains closed for at least one hour following the reset time. The beak switch 38 is also connected to the microprocessor 56, as is the time-base element 58 in the form of a quartz crystal for generating timing signals in the circuit 50. Program and alarm signal information is stored in the read-only memory 60, which is preferably an EPROM. An 8-bit latch 102 is connected on a bus between the memory 60 and microprocessor 56 for data addressing purposes. The latch 102 of one embodiment is a National 74C373 chip. Digital signals corresponding to the rooster call, or "cock-a-doodle-doo" sound, are transmitted to the digital-to-analog converter 64, which in the illustrated embodiment is an Octal "D" flip-flop chip 104. One example of such a "D" flip-flop in a National 74C374 chip. At the outputs of the "D" flip-flop are connected a plurality of resistors 106 connected in parallel. From the resistors 106, a signal is transmitted to an operational amplifier 108 connected for summing and low-pass functions.

A program-controlled output lead 110 from the microprocessor 56 is connected to the base of transistor 112 and disable input of Octal "D" flip-flop 104 to turn off the sound-generating function when not needed in order to conserve battery energy. The transient-suppressing section 66 includes a capacitor 114 and an operational amplifier 116. The outputs of the operational amplifiers 108 and 116 are connected to the two terminals of the speaker 70 so that the sound produced thereby is broadcast from the clock 10.

Two different power sources may be provided for the circuit 50 by a power supply portion 118. The power supply portion 118 is either powered by four series connect batteries 120 or by connection to a regulated external supply, such as a 76 volt DC signal connected at a socket 122, the 6 volt DC supply being generated by an external transformer 124 that is selectively connected to the socket 122 by a pin connector 126. A variety of diodes 128, filtering capacitors 131 an inductor 132 are provided in the circuit 118 to insure careful power regulation. Thus, if AC power fails, the battery power supply 120 takes over.

The present circuit conserves power drain in that the circuit is in a low drain, resting state unless the clock switch 100 is activated.

Referring now to FIG. 5, a second embodiment of the alarm clock of the present invention is shown. In this embodiment an electronic or "digital" clock display and mechanism 90 has replaced the analog clock assembly 12 of FIGS. 1 and 2 in the front side 32 of base 30.

Aside from this and the corresponding reduction in the size of side 32 however, this second embodiment of the present invention is nearly identical to the alarm clock of FIGS. 1 and 2.

Referring now to FIG. 6, a third embodiment of the alarm clock of the present invention is shown. In this embodiment the analog clock display and mechanism 12 of FIGS. 1 and 2 is located within the rooster body 14 rather than in the base 30. Specifically, the analog clock assembly 12 is mounted on a hinged, swing-out frame (not shown) which is centered on the rooster's chest. Releasing a simple "snap" or "button" locking mechanism on the rooster body or clock assembly frame allows one access to the time and alarm setting posts located on the rear of the clock mechanism. An extended alarm control output 54 passes from the clock mechanism down through the rooster body 14 and through the remaining hollowed-out foot 28 to the alarm circuitry 50 in base 30. Aside from these changes and the corresponding elimination of setting post access holes on the underside of base 30, this third embodiment of the present invention is nearly identical to the alarm clock of FIG. 5.

Although other modifications and changes may be suggested by those skilled in the art, it is the intention of the inventor to embody within the patent warranted hereon all changes and modifications that reasonably and properly come within the scope of his contribution to the art.

I claim as my invention:

1. An alarm clock for broadcasting an alarm signal at a predetermined time, comprising:

a housing;

a first portion of said housing having the shape of a type of animal, a second portion of said housing providing a base for said animal shape;

said animal having a characteristic sound, said first portion including an anatomical feature reflective of a source for said characteristic sound in animals of that type;

a clock mechanism and clock display mounted within said housing;

a manually operatable switch associated with said anatomical feature;

a sound generating circuit connected to said clock mechanism and to said switch and effective to generate said characteristic sound at a predetermined time as determined by said clock mechanism;

said switch effective to disable said characteristic sound; and said anatomical feature having portions thereof movable with respect to other portions of said housing to activate said switch.

2. An alarm clock as claimed in claim 1, wherein said first portion of said housing is a plush representation of a type of an animal and the characteristic sound is a call of said type of animal.

3. An alarm clock as claimed in claim 1, wherein said sound generating circuit is contained within said base.

4. An alarm clock as claimed in claim 1, wherein said clock mechanism and clock display are digital, said clock mechanism being contained within said base and being connected to said clock display.

5. An alarm clock as claimed in claim 1, wherein said sound generating circuit includes:

a microcomputer connected for operation upon receipt of a signal from said clock mechanism;

a memory connected to said microcomputer for storing a signal corresponding to said characteristic sound;

an analog-to-digital converter connected to said microcomputer to receive said signal corresponding to said characteristic sound;

an amplifier connected at an output of said analog-to-digital converter; and a speaker connected at an amplified output of said amplifier for broadcasting an audio alarm signal in the form of said characteristic sound.

6. An alarm clock as claimed in claim 5, further comprising:

a time-base means operable in conjunction with said microcomputer for timing an interval during which reoccurring sequences of said characteristic sound are produced.

7. An alarm clock as claimed in claim 6, wherein said manually operatable switch is connected to said microcomputer to cancel said reoccurring sequences of said characteristic sounds.

8. An alarm clock as claimed in claim 1, wherein said anatomical feature is a body part of the represented animal from which said characteristic sound is popularly believed to emanate.

9. An alarm clock as claimed in claim 8, wherein said type of animal is a rooster and said anatomical feature is a beak of said rooster.

10. An alarm clock for indicating a predetermined time by an alarm signal, comprising:

a figure in the shape of an animal;

a clock mechanism having a time display;

a disable switch operable by manipulation of a feature on said animal figure, said feature being reflective of a source for a sound in animals of that type;

an alarm circuit conected to said clock mechanism and to said disable switch including:

a programmed control unit having means for storing data representing a sound characteristic of the animal represented by said animal figure;

means for broadcasting said characteristic sound at a predetermined time, said disable switch being effective to interrupt broadcast of said characteristic sound; and means for broadcasting further of said characteristic sounds in a sequence following said predetermined time, said disable switch being effective to interrupt said sequence of characteristic sounds.

11. An alarm clock as claimed in claim 10, wherein said alarm circuit includes:

a battery power supply.

12. An alarm clock as claimed in claim 10, further comprising:

means for connecting said alarm circuit to AC power.

13. An alarm clock for broadcasting an alarm signal at a predetermined time, comprising;

a base member;

a housing in the shape of an animal which has a characteristic sound, said housing being affixed to said base member;

a clock display and clock mechanism mounted within said base member;

a manually operatable alarm shut-off and reset switch forming a body part of said animal from which said charactertic sound is popularly believed to emanate;

means for broadcasting said characteristic sound mounted within said base;

a power source in said base; and a sound generating circuit connected to said clock mechanism and said power source and said sound broadcasting means and said switch to produce said characteristic sound at a predetermined time as regulated by said clock mechanism, said sound generating circuit being disabled by operation of said switch.

* * * * *